United States Patent [19]

Kaneko et al.

[11] Patent Number: 4,749,973

[45] Date of Patent: Jun. 7, 1988

[54] WAVEGUIDE FILTER USED IN A MICROWAVE OVEN

[75] Inventors: Kazuo Kaneko, Yokohama; Kohji Iwabuchi, Chiba; Akikazu Harada, Mobara, all of Japan

[73] Assignee: Hitachi Heating Appliances Co., Ltd., Chiba, Japan

[21] Appl. No.: 871,851

[22] Filed: Jun. 9, 1986

[30] Foreign Application Priority Data

| | | | |
|---|---|---|---|
| Jun. 20, 1985 | [JP] | Japan | 60-134943 |
| Oct. 3, 1985 | [JP] | Japan | 60-220880 |
| Dec. 19, 1985 | [JP] | Japan | 60-286687 |

[51] Int. Cl.[4] ..... H01P 1/212

[52] U.S. Cl. ..... 333/210; 333/211; 219/10.55 A

[58] Field of Search ..... 333/210, 211, 208; 219/10.55 R, 10.55 A, 10.55 F

[56] References Cited

U.S. PATENT DOCUMENTS

| | | | |
|---|---|---|---|
| 3,537,040 | 10/1970 | Matthaei et al. | 333/211 |
| 3,758,737 | 9/1973 | Ironfield | 333/209 X |
| 3,851,131 | 11/1974 | Johnston et al. | 333/230 |

FOREIGN PATENT DOCUMENTS

| | | | |
|---|---|---|---|
| 0680087 | 8/1979 | U.S.S.R. | 333/208 |
| 0860182 | 8/1981 | U.S.S.R. | 333/202 |

*Primary Examiner*—Eugene R. LaRoche
*Assistant Examiner*—Benny Lee
*Attorney, Agent, or Firm*—Antonelli, Terry & Wands

[57] ABSTRACT

A waveguide filter for use in a microwave oven having a plurality of metallic plates disposed in a waveguide in substantially parallel to side walls of the waveguide. The metallic plates are provided in the upper and lower edges thereof with a series of openings at a constant interval so as to provide a corrugated configuration. First members are disposed for providing a certain spacing between adjacent ones of the metallic plates and holding the metallic plates substantially in parallel to one another; and second members including metal members are disposed between the side walls of said waveguide and the ones of the metallic plates adjacent the waveguide side walls for creating a substantially uniform clearance between the upper and lower edges of the metallic plates and the upper and lower walls of the waveguide and for holding the metallic plates substantially in parallel to the waveguide side walls.

6 Claims, 14 Drawing Sheets

WAVEGUIDE FILTER USED IN A MICROWAVE OVEN

BACKGROUND OF THE INVENTION

This invention relates to a microwave oven used for cooking and, particularly, to a waveguide filter used in a microwave oven for eliminating harmonic noises created by the magnetron and preventing microwave radiation outside of the heating chamber.

The frequency (fundamental wave) assigned to the operation of microwave ovens is 2.45 GHz±50 MHz. A magnetron used in a microwave oven produces frequency components (noises) other than the fundamental component although their levels are extremely low. Leakage of such noises from a microwave oven is seriously influential upon other electronic appliances, and therefore various measures are taken in designing a microwave oven. Conventional microwave ovens are provided with a filter within a waveguide which conducts the microwave from the magnetron to the heating chamber so as to eliminate noises, as described, for example, in Japanese patent publication Nos. 59-16713 and 59-16714. Although such a filter arrangement is effective against noises relatively close to the fundamental wave, it is not intended to eliminate higher harmonic components.

Recently, broadcasting satellites have been launched, and television signals are transmitted directly from each satellite to the home audience. The frequency band assigned to broadcasting satellites is 11.7–12.7 GHz, and it coincides with the fifth harmonic, i.e., 12.0–12.5 GHz, of microwave ovens. Therefore, a leakage of the fifth harmonic from a microwave oven can adversely affect television sets which are tuned to satellite broadcasting stations.

In order to eliminate the spurious emission from microwave ovens, there has been proposed a broadband filter as described in U.S. Pat. No. 3,758,737. This technique, however, does not cover high order modes and is relatively expensive.

SUMMARY OF THE INVENTION

An object of this invention is to provide a waveguide filter for use in a microwave oven with the intention of effectively eliminating a specific harmonic, e.g., fifth harmonic, among numerous highorder modes created in the waveguide, at a low manufacturing cost.

It is a known fact that when a waveguide designed to transmit a fundamental wave allows the transmission of the fifth harmonic, for example, it can be transmitted in many modes. For example, a standard waveguide WRJ-2 (EIA standard WR-430) for transmitting a fundamental wave at 2.45 GHz±50 MHz has cross-sectional dimensions of 109.22 mm by 54.61 mm, and therefore the fifth harmonic at 12.0–12.5 GHz, for example, can be transmitted in tens of harmonic modes. It is difficult to block the microwave transmitted in so many highorder modes using a single filter. The present invention is intended to preclude the transmission of TEmo modes by the use of corrugated sections directed to the outlet of the waveguide on a metallic block fixed inside the waveguide, and to block the transmission of TEmn and TMmn modes by base sections existing between the corrugated sections. By separate elimination of the TEmo mode and TEmn/TMmn modes, a specific harmonic, e.g., the fifth harmonic in these modes, introduced in the waveguide is completely removed.

Instead of the above-mentioned metallic block, use of a filter arranged as described below is also effective. The filter is made of several metallic plates disposed face to face with spacers provided therebetween in the direction substantially perpendicular to the outlet axis of the waveguide and with cuts being formed periodically in the upper and lower edges of each metallic plate.

DESCRIPTION OF THE PREFERRED EMBODIMENTS

Figure 1:
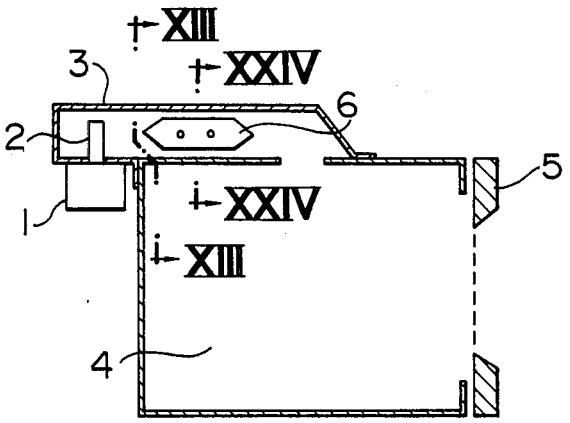
FIG. 1 is a cross-sectional view of the principal portion of the waveguide filter used in a microwave oven embodying the present invention.

An embodiment of this invention will now be described with reference to the drawings. In FIG. 1 showing the cross-section of the microwave oven to which the present invention is applied, a magnetron 1 generates microwave power, which is emitted by an antenna 2 and fed through a waveguide 3 into a heating chamber 4. A door 5 is used to provide access to the interior of the heating chamber 4 for foods to be cooked. A waveguide filter (will be termed simply "filter" hereinafter) 6 is provided with the intention of preventing the fifth harmonic generated by the magnetron 1 and emitted by the antenna 2 into the waveguide 3 from radiating into the heating chamber 4.

Figure 2:
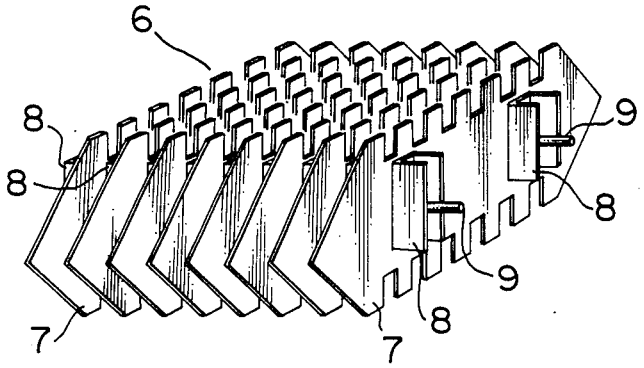
FIG. 2 is a perspective view of the filter.

FIG. 2 is a perspective view of the filter 6. The filter 6 is made up of eight elongated metallic plates 7 each tapering at both ends with a pair of spacers 8 welded on one side of each plate so that the plates are arranged face to face in parallel. Each of both end plates 7 in the figure has spacers 8 on both sides. The eight metallic plates 7 are secured in a parallel configuration by being linked together with metallic shafts 9, each running through a hole formed at the middle in height of the spacer 8. The metallic plate 7 is arrowheaded at both ends and formed with series of cuts at its upper and lower edges as shown. The spacer 8 is made of a metallic sheet formed in a channel cross-section. The shaft 9 is a metallic stud bolt threaded in both end sections.

Figure 3:
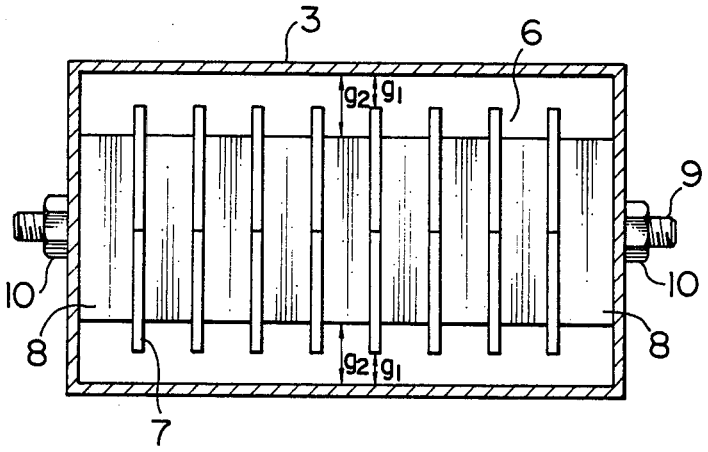
FIG. 3 is a partial cross-sectional view of the filter accomodated in the waveguide.

FIG. 3 is a side sectional view of the filter 6 accommodated in the waveguide 3. The shaft 9 runs through the side walls of the waveguide 3 in their virtually central portion, and secured by nuts 10. The filter 6 is positioned to the center of the waveguide 3 with a clearance g1 being set at the top and bottom between the waveguide walls and the metallic plates 7 and another clearance g2 between the waveguide walls and the spacers 8.

Next, the operation of this embodiment will be described. In the foregoing arrangement of the filter 6, (1) the fundamental wave is transmitted virtually without loss, and (2) the fifth harmonic is blocked almost completely, specifically other modes than TEmo mode (i.e., TEmn and TMmn modes) are precluded almost completely by the following reason. Any mode other than TEmo mode does have an electric field component parallel to the upper and lower walls of the waveguide 3, and therefore the harmonic cannot pass through the filter 6, with the only exception being allowed when the clearance g2 is large. Assuming the that the clearance g2 is smaller than half the space wavelength $\lambda o$ of the fifth harmonic, the fifth harmonic of a mode having an electric field component is cut off and it cannot pass, as is known in the art. Accordingly, by choosing the height of the spacer 8 appropriately, transmission of modes other than TEmo is precluded. Specifically, in this embodiment, the spacer 8 has a channel cross-section as shown in FIG. 2, forming a 4-stage blocking structure in the axial direction, and satisfactory performance is promised.

The following describes the reason of the transmission of the fundamental wave without loss, and the reason of the complete blocking against the fifth harmonic in TEmo modes. For simplifying the explanation, the transmission of the fundamental wave will first be described for the case of the filter structure having no spacers 8 and without the formation of cuts in the longitudinal edge sections of the metallic plates 7, before entering into the complete structure.

Figure 4:
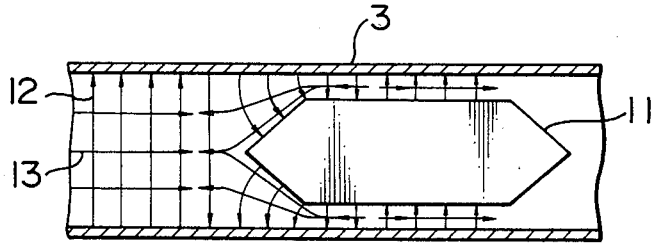
FIGS. 4, 5, 6, 7, 8 and 9 are diagrams used to explain the behavior of the electromagnetic field and surface current in the waveguide.

FIG. 4 is a side cross-sectional view of the transmission of the fundamental wave. The fundamental wave is in procession from left to right in the figure. As is known in the art, the fundamental wave has the TE10 mode, and accordingly the electric field and magnetic field are formed as shown by 12 and 13, respectively. Due to the tapered shape of the metallic plates 11, the electromagnetic field arriving at the plates 11 splits sharply into upper and lower parts. Since the clearance g1 is virtually equal at the top and bottom sections as shown in FIG. 3, the electromagnetic field is split evenly into two.

Figure 5:
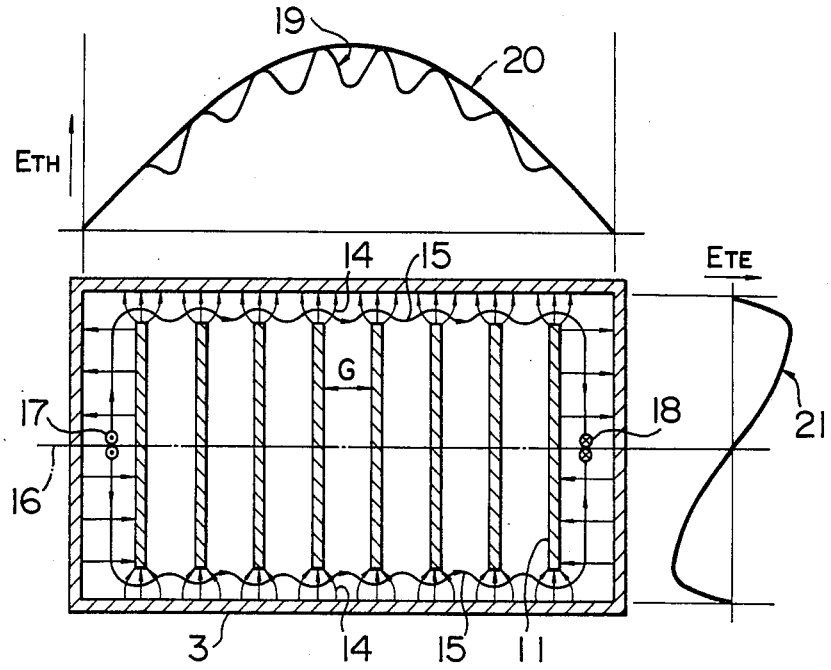

FIG. 5 shows in cross section the split electromagnetic field seen from the magnetron. The electric field and magnetic field are each split into upper and lower parts as shown by 14 and 15, respectively. The electromagnetic field does not exist between adjacent metallic plates 11 because of their spacing G being made sufficiently smaller than the cutoff dimension of the fundamental wave. It cannot be avoided that the electromagnetic field enters both end sections between the metallic plates 11 and the side walls as shown. In these sections, the electric field has the split upper and lower components with an equal magnitude and opposite direction, resulting in the nullity on the center line 16. The magnetic field in these sections is normal to the drawing as shown by symbols 17 and 18. Curve 19 in the figure indicates the magnitude of electric field, $E_{TH}$, at positions closely below the upper wall, while curve 21 indicates the magnitude of electric field, $E_{TE}$, at positions closely inside the right-hand wall. The magnitude $E_{TH}$ fluctuates, making positive peaks at the metallic plates 11 and negative peaks at the middle of adjacent metallic plates 11. Evenlope 20 of the positive peaks retains the feature of the original TE10 mode. The magnitude $E_{TE}$ has peaks in the vicinity of the longitudinal edge sections of the metallic plates 11 and it is nullified on the center line 16. On this account, partitioning of the waveguide 3 with a metal plate placed perpendicularily to the drawing along the center line 16 has no influence on transmission. The electromagnetic field concentrates in the outer sections of the eight metallic plates 11, and therefore this transmission line is equivalent to two vertically confronting waveguides having a channel cross section, disposed along the center line 16. This analogy to two vertically confronting waveguides will become more apparent from the following description on the surface current.

Figure 6:
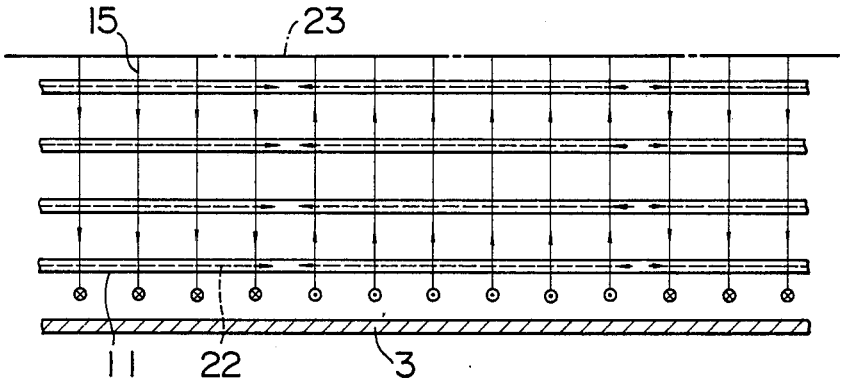

FIG. 6 shows in cross section the flows of currents in the metallic plates 11 seen from the top wall of the waveguide 3. The cross section shown is the lower half of the structure below the waveguide axis 23. The dashed arrows indicate the currents flowing on the surface of the metallic plates 11, while the solid arrows indicate the magnetic field. Since the current and magnetic field must intersect at right angles, a current 22 on the edge of a metallic plate 11 flows only in the direction parallel to the waveguide axis 23 with its flowing direction reversing at every half-wave length.

Figure 7:
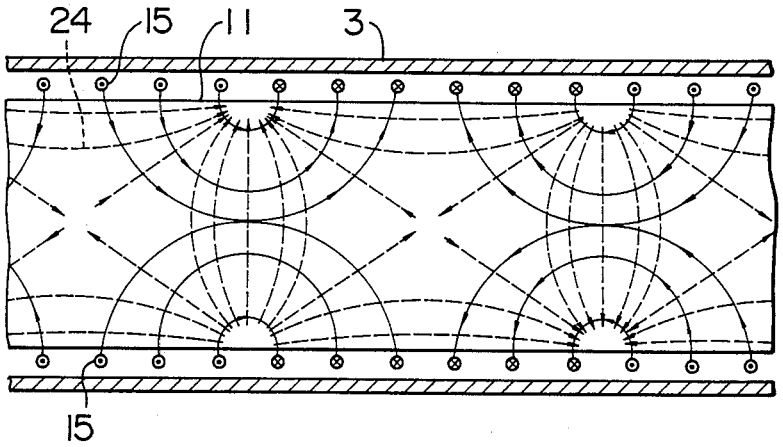

FIG. 7 shows the surface current flowing in the outermost metallic plates 11 among the eight metallic plates 11. The dashed arrows indicate the surface current, and the solid arrows indicate the magnetic field. As can be seen from the behavior of the surface currents in FIGS. 6 and 7, the structure is equivalent to two vertically confronting two waveguides having a channel cross section for the usual waveguide mode TE10. On this account, this transmission line transmits the fundamental wave virtually without loss.

The following describes the influence on the fundamental wave of the aforementioned corrugated configuration made by the metallic plates 7 and spacers 8. As can be seen from the comparison of FIGS. 3 and 5, only the outermost spacers 8 affect the transmission of the fundamental wave. However, their influence ranges only to the $E_{TE}$ components in both outer sections, which are trivial as compared with the total energy, and only little discontinuity results. Discontinuity to such a degree does not hamper matching, and yet matching can be done automatically through the cancellation of reflections by choosing the interval of the spacers 8 appropriately. The corrugated configuration is provided for the elimination of the fifth harmonic, as will be explained later, and its depth and spacing are negligibly small relative to the fundamental wave. The only caution to be used is the matching of the load impedance since the wavelength is slightly reduced.

These are the reasons for fundamental wave transmission without loss, and the following describes the reason of precluding the transmission of the fifth harmonic in TEmo modes. For the easiness of explanation also in this case, the filter structure without the spacers 8 and with the metallic plates 7 having no cuts in their upper and lower edges will first be described, and the complete structure next.

First, the fifth harmonic in the TE10 mode will be described. The fifth harmonic in the TE10 modes has the same shape as the fundamental wave, and the only difference is its shorter wavelength. Accordingly, the electromagnetic field is essentially the same as that shown in FIG. 4, and the figure shows the behavior of the fifth harmonic in the TE10 mode provided that the wavelength is shorter in this case. On the same basis, the models of FIGS. 5, 6 and 7 can be applied commonly to the fifth harmonic in the TE10 mode. A condition of using FIG. 5 is that the spacing G of the metallic plates 11 is selected below half the space wavelength λ05 of the fifth harmonic. Otherwise, electric field components parallel to the metallic plates 11 would enter into all spaces made by the metallic plates 11, ruining their effectiveness.

Figure 8:
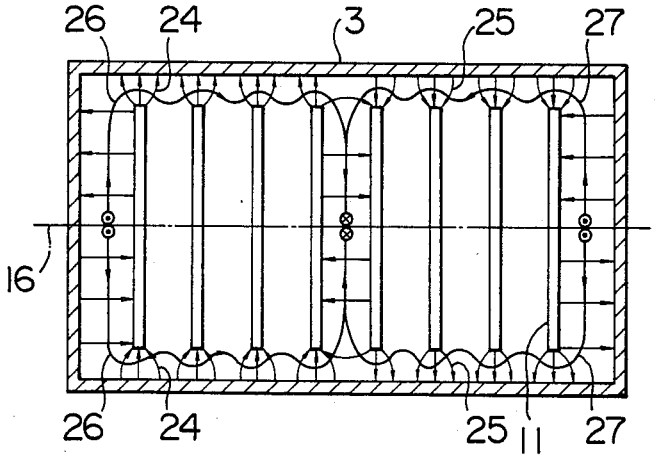
Figure 9:
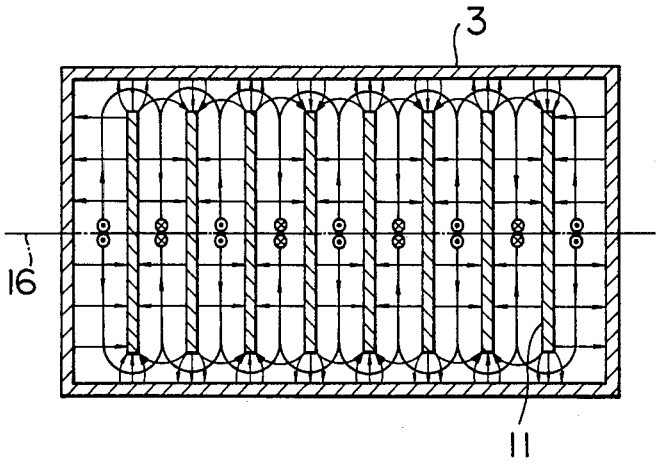

Transmission of the fifth harmonic in the TE10 mode as shown in FIG. 5 creates substantially no loss, which is equivalent to the structure of two waveguides with a channel cross section confronting on both sides of the center line 16, as described previously. On this account, the procession of the TE20 mode from the left in FIG. 4 must result in the division of the electromagnetic field by the metallic plates 11 as shown in FIG. 8. Namely, the electric field is split as shown by 24 and the magnetic field is split as shown by 26 in the left half section. Similarly, the electric field and magnetic field in the right half section are split as shown by 25 and 27, respectively, with their directions indicated by the arrows. In this case, the electromagnetic field enters the central space made by the adjacent metallic plates 11. Accordingly, it is equivalent to four waveguides with a channel cross section, each pair confronting on both sides of the center line 16, and transmission with virtually no loss is possible. Similarly, the arrangement of FIG. 9 is the case of the TE80 mode, in which the electromagnetic field enters all spaces between adjacent metallic plates 11, and it is equivalent to the structure of 16 waveguides, each pair confronting on both sides of the center line 16. identical results are reached for other modes RE30, TE40, TE50, TE60 and TE70, although they are not shown, The odd-numbered modes TE30, TE50 and TE70 slightly differ from the cases shown that have the even number (8) of metallic plates 11, but there are no essential differences amoung all.

A material fact to be noted here is that the surface currents flowing on the upper and lower edges of the metallic plates 11 are parallel to the waveguide axis 23 in any mode (TEmo) as shown in FIG. 6. A more material fact is that the fifth harmonic has its guide wavelength substantially unique in any mode.

Figure 10:
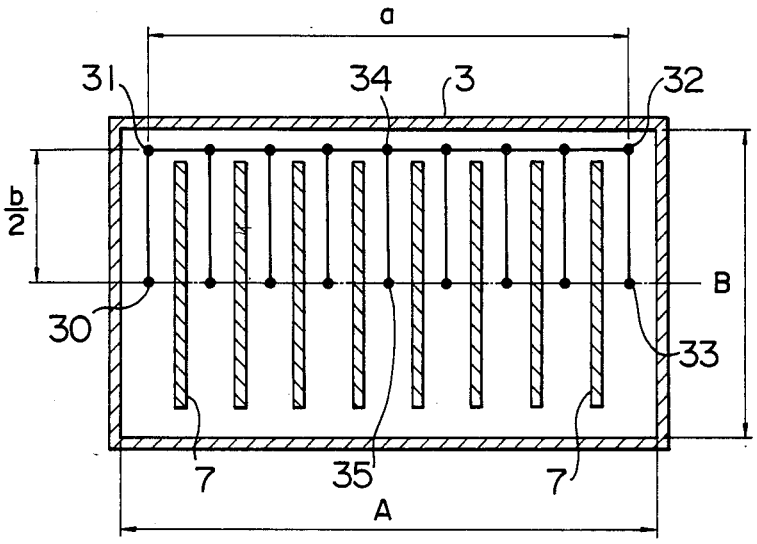
FIG. 10 is a diagram showing the concept of determining the cutoff wavelength.

The uniqueness of the guide wavelength will be described using FIG. 10. In a usual waveguide where all metallic plates 7 shown are absent, the cutoff wavelength λcm is express by the following equation.

$$\lambda cm = 2A/m \tag{1}$$

where A denotes the lateral dimension of the waveguide. On the other hand, the cutoff wavelength of the TE10 mode, as has been described on FIG. 5, is determined by the waveguide having a channel cross section, and it is the same as a waveguide having a lateral dimension ranging from point 30 to 31 to 32 to 33 in FIG. 10. Accordingly, the cutoff wavelength in the TE10 mode, λc1, is given as, $$\lambda c1 = 2\left(\frac{b}{2} + a + \frac{b}{2}\right) = 2(a + b) \tag{2}$$

where a and b denote the dimensions defined in FIG. 10 Similarly, the cutoff wavelength of TE20, λc2, is determined by the waveguide having a laterial dimension ranging from point 30 to 31 to 34 to 35 to 34 to 32 to 33, based on FIGS. 8 and 10.

$$\lambda c2 = \frac{2\left(\frac{b}{2} + \frac{a}{2} + \frac{b}{2} + \frac{b}{2} + \frac{a}{2} + \frac{b}{2}\right)}{2} = a + 2b \tag{3}$$

Accordingly, the cutoff frequency of TEmo, λcm, is generally expressed as follows.

$$\lambda cm = 2a/m = 2b \tag{4}$$

For comparing Equations (1) and (4), rough approximations are made as, $$a \approx A, b \approx B = A/2 \tag{5}$$

Then, Equation (4) is reduced to, $$\lambda cm \approx 2A/m + A \tag{6}$$

This equation implies that the cutoff wavelength becomes longer by A than that given by Equation (1) in any mode.

As has been described previously, the fundamental wave oriented standard waveguide WRJ-2 (EIA WR-430) has guide wave length λg10 and λg80 for the fifth harmonic in the TE10 and TE80 modes at 12.25 GHz as follows.

λg10=24.65 mm and λg80=50.38 mm

In contrast, Equation (6) gives, $\lambda g10 = 24.56$ mm and $\lambda g80 = 24.89$ mm There is little difference between λg10 and λg80. It means that eight modes of TE10–TE80 have a virtually equal giude wave length. This fact is quite important, since the structure for precluding the transmission of the fifth harmonic can have unique dimensions for all modes, as will be described later.

Next, the effect of the cut configuration formed in the spacers 8 will be desribed. The provision of the spacers 8 in FIG. 2 prevents the electromagnetic field from entering spaces between metallic plates 7, as is obvious from the comparison with FIG. 9, but this effect is not enough. As has been described in connection with FIG. 5 about the transmission of the fundamental wave, the preventive effect by the spacers 8 is less expected against the TE10 modes of the fifth harmonic. On this account, the major preventive effect against the fifth harmonic in TEmo modes is to be ascribable to the formation of cuts on the metallic plates as will be described in the following.

Figure 11A:
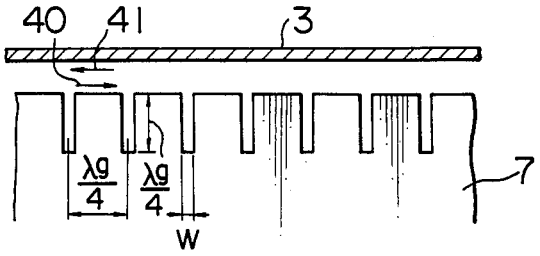
FIG. 11 is a set of diagrams explaining the shape of filter elements and performance, FIG. 11(A) showing the shape of filter elements, FIG. 11(B) showing the equivalent circuit of the filter, FIG. 11(C) showing the filter characteristics.
Figure 11B:
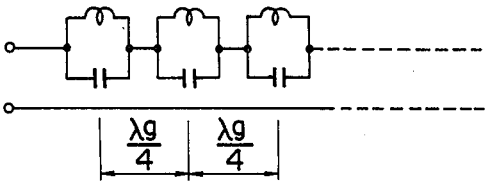
Figure 11C:
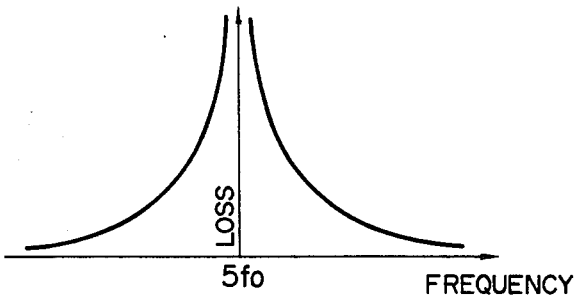

FIG. 11(A) shows an example of cuts formed in the metallic plates 7. At the interval of a quarter guide wave length λg, cuts each having a relatively narrow width w and a depth of λg/4 are formed regularly. The surface current 40 shown in FIG. 6 flows in this section, which creates a counter surface current 41 on the confronting upper (and lower) wall of the waveguide 3. Accordingly, this section can be expressed equivalently as tow parallel lines as shown in FIG. 11(B). Each cut is represented by a tank circuit resonant at the frequency derived from λg connected in series on the parallel lines. This equivalent circuit is expected to have an extremely large preventive effect by the insertion loss by making λg equal to 5fo (fifth harmonic) as shown in FIG. 11(C). The λg is virtually constant in TEmo mode as mentioned previously, and the same effect is achieved for any mode.

Figure 12A:
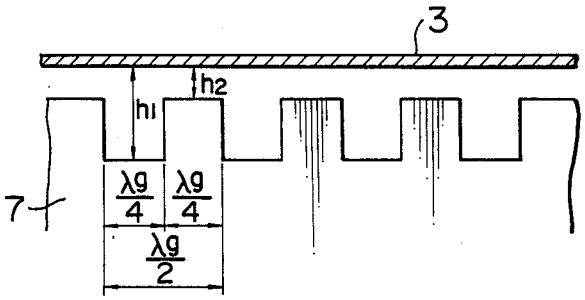
FIG. 12(A)–12(C) are diagrams showing another example of the shape and characteristics of the filter.
Figure 12B:
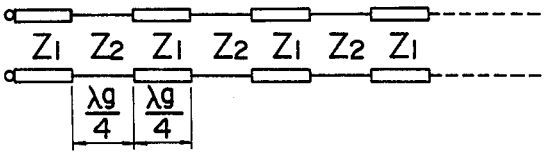
Figure 12C:
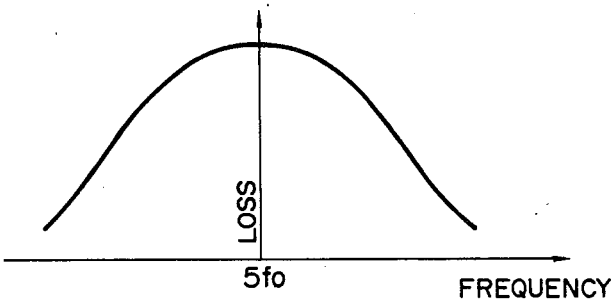

FIG. 12(A) shows another example of the cut formation, in which case cuts are formed with a width of λg/4 at an interval of λ/2, with clearance dimensions h1 and h2 being defined as shown. The equivalent circuit is as shown in FIG. 12(B), in which lines of characteristic impedances Z1 and Z2, each having a unit length of λg/4, are connected alternately. The equivalent circuit creates the insertion loss as shown in FIG. 12(C), and it preventive effect at frequency 5fo is less than the case of FIG. 11, but with a collateral broad-band response. The characteristic impedance is conceivably proportional to the distance to the wall of the waveguide 3, and the following relationship is met.

$$Z1/Z2 = h1/h2 \quad (7)$$

Accordingly, the larger the ratio of h1 to h2, the greater preventive effect is achieved.

The second embodiment of this invention will be described with reference to FIGS. 13 through 23. Major differences from the first embodiment reside in the spacer section.

Figure 13:
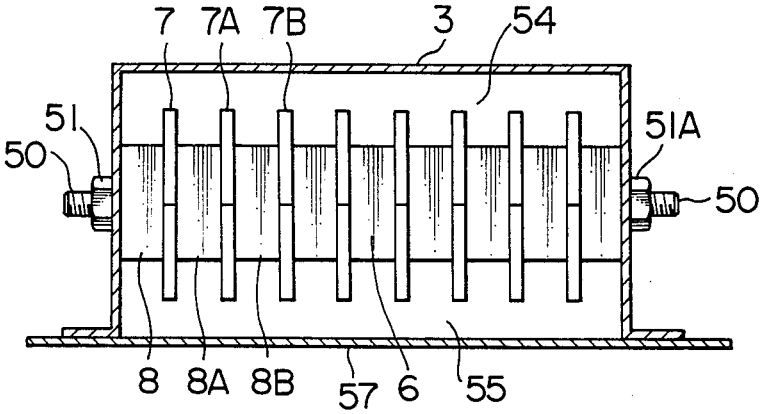
FIG. 13 is a cross-sectional view, taken along the line XIII—XIII of FIG. 1, showing the second embodiment of this invention.
Figure 14A:
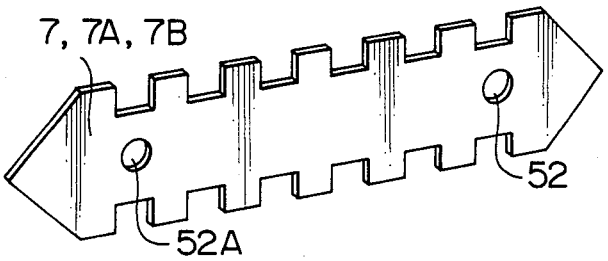
FIG. 14(A) and 14(B) are perspective views of the metallic plate and spacer of the filter respectively.
Figure 14B:
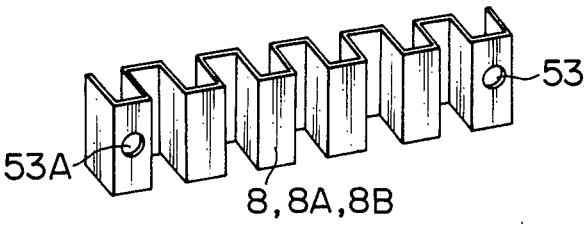

FIG. 13 is a cross-sectional view taken along the line XIII—XIII of FIG. 1. Metallic plates 7, 7A, 7B, and so on, and metallic spacers 8, 8A, 8B, and so on, are aligned alternately and secured to the side walls of the waveguide 3 by means of shafts 50 running through them and nuts 51 and 51A. The metallic plates 7, 7A, 7B, and so on are spaced out from one another by a distance smaller than half the space wavelength λ of the harmonic. The same spacing is provided between the outermost metallic plates and the side walls of the waveguide 3. Each metallic plate 7 has the shape as shown in FIG. 14(A). The plate tapers at both ends and has a series of cuts in its upper and lower edge sections. Holes 52 and 52A are formed in the plates so as to allow the shafts 50 and 50A (not shown in FIG. 14(A)) to run through. FIG. 14(B) shows the shape of each spacer 8. The spacers are made in a corrugated formation with linkage holes 53 and 53A being formed in both end sections so as to allow the shafts 50 and 50A to run through when assembled with the metallic plates. Each spacer has bends at a constant interval, which may be equal to the interval of cuts formed in the metallic plates.

In FIG. 13, the shaft 50 is supported at the middle between the top and bottom of the waveguide 3, and therefore the room 54 between the filter top and the waveguide wall has virtually the same shape and dimensions as those of the room 55 between the filter bottom and the ceiling 57 of the heating chamber. On this account, the fundamental wave and harmonics radiated from the antenna 2 are split equally into the room 54 and room 55. The following describes the behavior of the fundamental wave and harmonic only in the room 54, and that in the room 55 which is identical to the former will be omitted.

The filter structure described above has the ability that (1) The fifth harmonic is blocked almost completely, and (2) The fundamental wave is transmitted virtually without loss. These are based on the same reason as described in detail in the first embodiment, and it will not be repeated here.

Figure 15:
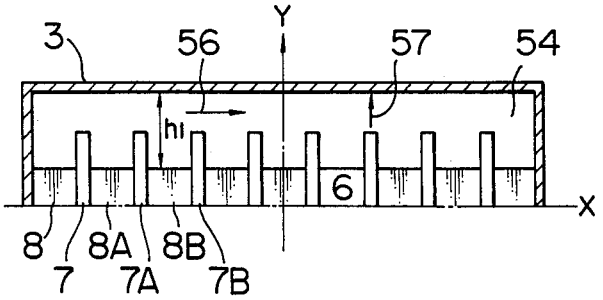
FIG. 15 is a diagram explaining the electric field in the waveguide.

Referring to FIG. 15, if the dimension h1 is smaller than half the space wavelength λo, the electric field component 56 parallel to the x axis is cut off and cannot be propagated in the axial direction, as is known in the art. On the other hand, the lateral dimension of the waveguide 3 is large enough to propagate the electric field component 57 parallel to the y axis. That is, by choosing the height of the spacers 8, 8A, 8B, and so on appropriately, any mode other than TMmo can be blocked completely.

Figure 16:
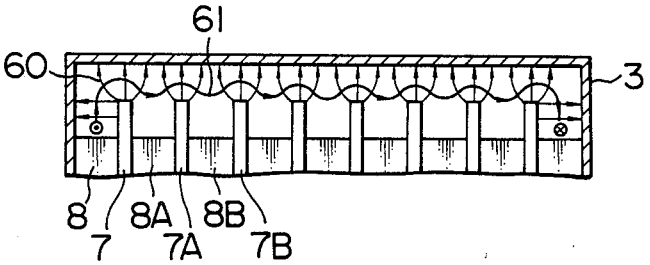
FIGS. 16, 17 and 18 are diagrams each showing the electromagnetic field in the waveguide.

The following describes the reason of the ability of virtually complete blockage also for TEmo modes owing to the presence of cuts in the edges of the metallic plates. For the easiness of explanation, the structure without the formation of cuts in the edges of the metallic plates will be described first, and the complete structure next. First, it is assumed that the formation of cuts is absent in FIGS. 16 through 19. FIG. 16 shows the behavior of the electromagnetic field when the TE10 mode is resonant with the room 54. The metallic plates 7, 7A, 7B, and so on are spaced narrowly enough so that the electric field 60 and the magnetic field 61 cannot enter in between except for both outermost sections as shown in the figure. The surface currents concentrate in the edge section of the metallic plates and flow only in the axial direction. Although a little current flows on the side of the outermost metallic plates, the TE10 mode can be propagated in the axial direction without substantial energy loss.

Figure 17:
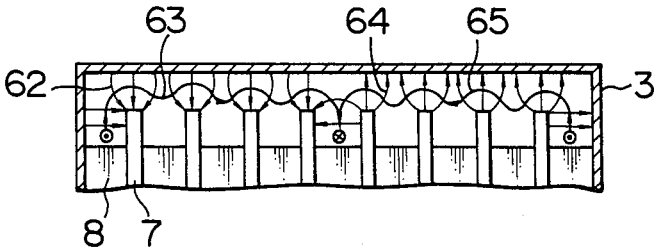

FIG. 17 shows the behavior of the electromagnetic field in the TE20 mode. As is known, the electric field reverses the polarity at the middle of the waveguide as shown by 62 and 64, and the magnetic field is formed as shown by 63 and 65. The electromagnetic field enters only in the outermost and central spaces. The surface currents flow in the axial direction on the edges of the metallic plates, as in the case of FIG. 16, but the current direction reverses at the center of the waveguide. Energy is propagated in the axial direction without substantial loss.

Figure 18:
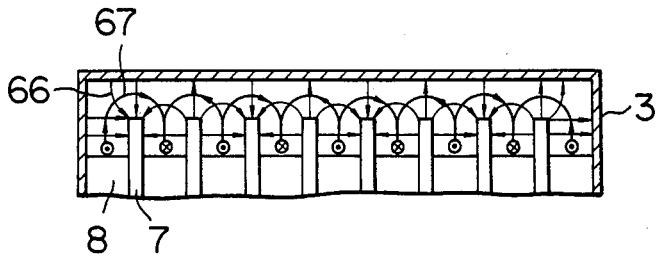

FIG. 18 shows the case of the TE80 mode, in which the electromagnetic field 66, 67 enters in every space between metallic plates. The surface currents flow in the axial direction on the metallic plate edges as in the cases of FIGS. 16 and 17, and energy is propagated without substantial loss.

Similar results are reached for the remaining modes TE30, TE40, TE50, TE60, TE70 and the like, although they are not shown. The odd-numbered modes TE30, TE50 and TE70 are slightly different from the illustrations that are for the structure having eight metallic plates, but there are no essential differences among all. In conclusion, if the metallic plates 7, 7A, 7B, and so on do not have the formation of cuts in their edges, the whole TEmo modes can be propagated without substantial loss and the surface currents flow in the edge sections in parallel to the waveguide axis.

Another material fact is that the guide wavelength is virtually constant for the whole TEmo modes regardless of the value of m. In conventional filters of this type, the guide wavelength varies greatly depending on the mode and therefore the dimensions of the filter need to be adjusted to each mode, whereas the inventive filter structure provides a virtually constant guide wavelength for any mode and does not need to change the dimensions.

The reason of a constant guide wavelength for the whole mode TEmo will be described using FIG. 19. For the usual waveguide in which all of the metallic plates 7 and spacers 8 are absent, the cutoff wavelength λcm of TEmo modes are expressed by the following equation.

$$\lambda cm = 2A/m \tag{11}$$

where A denotes the lateral dimension of the waveguide 3, and m represents an integer. The cutoff wavelength λc1 of the TE10 mode, mentioned with FIG. 16, is equal to the cutoff wavelength of a waveguide with a lateral dimension ranging from point 70 to 71 to 76 to 77 in FIG. 19. For a distance b between the spacer 8 and the upper wall of the waveguide 3 and a distance c between the metallic plate 7 and the upper wall of the waveguide 3, when assumption is made as c=b/2, the distance between points 70 and 71 becomes approximately 3b/4, and the cutoff wavelength λc1 is expressed as follows.

$$\lambda c1 = 2a = 3b \tag{12}$$

Figure 19:
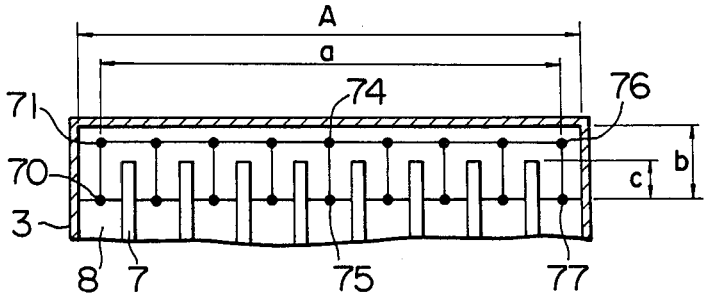
FIG. 19 is a diagram used to explain the determination of the cutoff wavelength.

Similarly, the cutoff wavelength λc2 of the TE20 mode in FIG. 17 is equal to the cutoff wavelength of a waveguide with a lateral dimension ranging from point 70 to 71 to 74 to 75 to 74 to 76 to 77 in FIG. 19. Accordingly, the cutoff wavelength becomes, $$\lambda c2 = a + 3b \tag{13}$$

Similarly, the cutoff wavelength λc8 of the TE80 mode becomes, $$\lambda c8 = a.4 + 3b \tag{14}$$

Accordingly, the cutoff wavelength of TEmo modes are generally expressed as, $$cm = 2a/m + 3b \tag{15}$$

Approximating $a \approx A$ gives, $$\lambda cm \approx 2A/m + 3b \tag{16}$$

Equation (16) yields a value greater by 3b than Equation (11). Namely, Equation (15) implies that the cutoff wavelength is longer for any mode (TEmo) by 3b than the usual waveguide.

As has been described previously, the fundamental wave oriented standard waveguide WRJ-2 (EIA WR430) provides guide wavelengths λg10 and λg80 in the TE10 and TE80 modes at the fifth harmonic frequency 12.25 GHz as, $$\left.\begin{aligned} \lambda g10 &= 24.65 \text{ mm} \\ \lambda g80 &= 55.38 \text{ mm} \end{aligned}\right\} \tag{17}$$

Using Equation (16), these cutoff wavelengths are calculated as, $$\left.\begin{aligned} \lambda g10 &= 24.60 \text{ mm} \\ \lambda g80 &= 26.56 \text{ mm} \end{aligned}\right\} \tag{18}$$

In the above calculation, the value of b is set to 12 mm in consideration that it is smaller than half the space wavelength (24.49 mm) of the fifth harmonic (12.25 GHz).

The guide wavelengths of the two modes by Equation (17) are apart by approximately a factor of 2, whereas the results of Equation (18) differ within 10%, indicating little difference of the guide wavelength depending on the mode.

These are the transmission of the fifth harmonic in the filter structure without the formation of cuts in the edges of the metallic plates. The conclusion is that the whole TEmo modes can be propagated without substantial loss, the surface currents flowing on the edges of the metallic plates are always parallel to the waveguide axis, and the guide wavelength is substantially constant regardless of modes TEmo.

Figure 20:
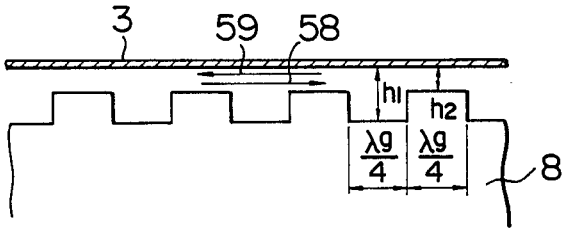
FIG. 20 is a diagram showing conceptually the shape of the filter element and the surface current.
Figure 21:
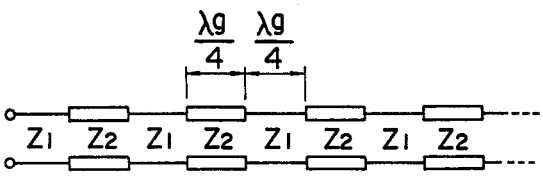
FIG. 21 is a diagram showing the equivalent circuit of the above filter structure.
Figure 22:
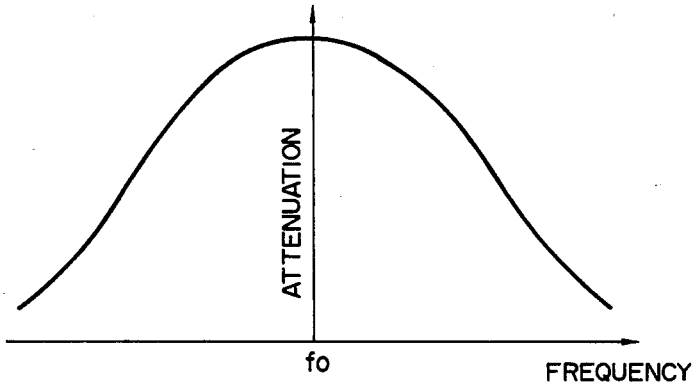
FIG. 22 is a graph showing the frequency response of the above filter structure.

The following describes the effect of the cut configuration of the metallic plates. In FIG. 20, cuts are formed at an interval of half the guide wavelength λg in the edge section of the metallic plate 7. The surface current 58 flows in parallel to the waveguide axis on the edge as mentioned previously, which causes a counter surface current 59 to flow in the opposite direction on the interior wall of the waveguide 3. These sections can be expressed equivalently as two parallel lines shown in FIG. 21. In the equivalent circuit, pair lines with characteristic impedances Z1 and Z2 each having a length of λg/4 are connected in series alternately. Such a circuit is known to have a relatively broad attenuation characteristics centered by the frequency fo derived from λg as shown in FIG. 22. Since λg is virtually constant for the whole TEmo modes as described above, the same attenuation effect is obtained for each mode of TEmo. The characteristic impedance is proportional to the distance as shown by h1 and h2 in FIG. 20, and the following relationship is met.

$$Z1/Z2=h1/h2= \quad (19)$$

Accordingly, the larger the ratio of h1 to h2, the greater blocking effect is accomplished. Namely, a satisfactory blocking effect can be attained by a simple filter structure which includes the metallic plates 7, 7A, 7B, and so on and the spacers 8, 8A, 8B, and so on manufactured through the inexpensive plate work.

Figure 23:
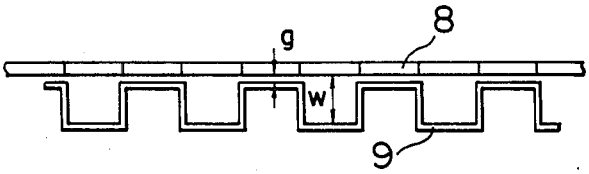
FIG. 23 is a diagram showing the clearance g between the metallic plate and spacer of the above filter structure.

FIG. 23 shows the filter structure in which a gap g is present between the metallic plate 7 and spacer 8. Such a gap can easily be created in the assembly of the metallic plates and spacers which are simply connected by the shafts 10. The presence of a gap allow the electric field component parallel to the x axis to enter in between, as has been mentioned on FIG. 15, with the apparent result of a significantly degraded harmonic blocking effect. Actually, however, the effect of the spacers 8, 8A, 8B, and so on negates this problem. The gap g and spacer width w in FIG. 23 are analogous in the relationship to h2 and h1 in FIG. 20, and the equivalent circuit is also similar to that shown in FIG. 21, providing the attenuation as shown in FIG. 22. The value of g is incomparably smaller than w, and the effect of transmission blockage is far greater than the case of FIG. 20. On this account, by assembling the metallic plates and spacers on the shafts which are secured on the side walls of the waveguide, while ignoring the creation of trivial gaps, a satisfactory performance can be obtained.

Next, the third embodiment of this invention will be described mainly for the case with the spacer distinct from the first and second embodiments.

Figure 24:
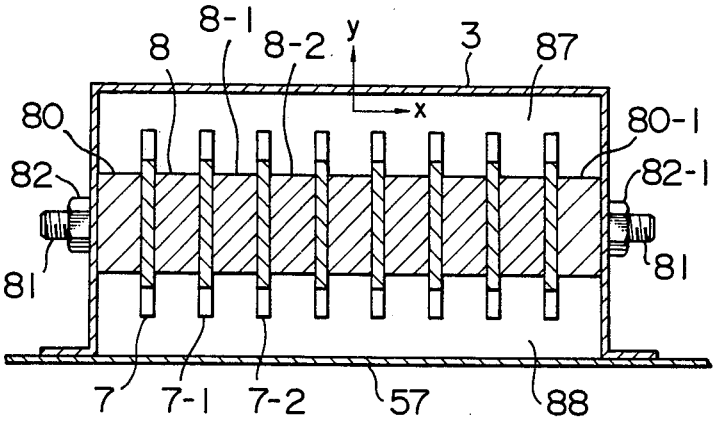
FIG. 24 is a cross-sectional view, taken along the line XXIV—XXIV of FIG. 1, showing the principal portion of the third embodiment of this invention.

FIG. 24 is a cross-sectional view taken along the line XXIV—XXIV of FIG. 1. Metallic plates 7, 7-1, 7-2, and so on, and absorbers 8, 8-1, 8-2, and so on are lined up alternately, with metallic spacers 80 and 80-1 being placed at both ends. These components are piled on a shaft 81 and secured to the side walls of the waveguide 3 using nuts 82 and 82-1. The metallic plates are spaced out by the width of the absorbers, which is smaller than half the space wavelength λo of the fifth harmonic. The metallic spacers 80 and 80-1 have the same width as the absorbers. Reference number 57 denotes the ceiling of the heating chamber, on which the waveguide 3 is welded to form a microwave transmission path.

Figure 25:
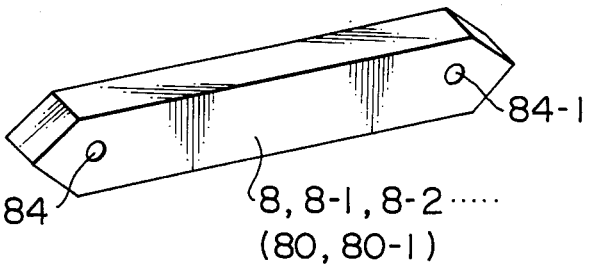
FIG. 25 is a perspective view of the principal component of the above filter structure.

FIG. 25 shows the shape of the absorbers and metallic spacers. both members have the same shape and differ only in material. The absorbers are made of a material, such as sintered ferrite or formed carbon, which actively absorbs the fifth harmonic, while the metallic spacers are made of any metallic material, preferably a metal causing little high-frequency loss. These components have holes 84 and 84-1 in both end sections, as in the metallic plates, through which the shafts 81 and 81-1 run.

In FIG. 24, the shaft is supported at the middle between the top and bottom of the waveguide 3, so that the rooms 87 and 88 formed between the filter 6 and waveguide 3, and between the filter and heating chamber ceiling 57 have virtually the same shape and dimensions. Accordingly, the fundamental wave and the fifth harmonic are propagated by being split equally into the rooms 87 and 88.

This filter structure is capable of (1) precluding the transmission of the fifth harmonic almost completely, and (2) transmitting the fundamental wave virtually without loss. The reasons are as follows.

First, other modes than TEmo, i.e., TEmn and TMmn, where m=0, 1, 2, . . . ; n=1, 2, 3, . . . , can be blocked almost completely by the following reason. These mode waves do have electric field components parallel to the upper and lower walls of the waveguide 3 (parallel to the x axis in FIG. 24), and their energy is absorbed by the absorbers 8, 8-1, 8-2, and so on. Electric field components parallel to the x axis cannot escape from entering into spaces between metallic plates 7, 7-1, 7-2, and so on, namely into the absorbers 8, 8-1, 8-2, and so on. Where the electric field exist, there exists the magnetic field intersecting with it at right angles, as is known in the art. Therefore, the absorbers, if made of sintered ferrite, absorb the magnetic field, or the absorbers, if made of carbon, absorb the electric field, and in any case energy is absorbed in the waveguide and it does not transmit modes other than TEmo. In contrast, TEmo mode waves have electric field components only in the y direction and have no components in the x direction. On this account, TEmo mode waves do not enter the absorbers 8, 8-1, 8-2, and so on, but go along the axis direction in the rooms 87 and 88.

Next, the reason of transmission blockage effected by series of cuts formed in the edge sections of the metallic plates will be described. For the expedience of explanation, the structure without the formation of cuts in the metallic plates will be described first, and the complete structure next. When the cut configuration is absent, TEmo mode waves are propagated without loss or with little loss (depending on each mode), whereas the presence of cuts precludes the transmission almost completely, as will be described in the following. To avoid the complexity of the drawing, the absorbers 8, 8-1, 8-2, and so on, and the shaft 81 are omitted in FIGS. 26, 27, 28 and 29.

Figure 26:
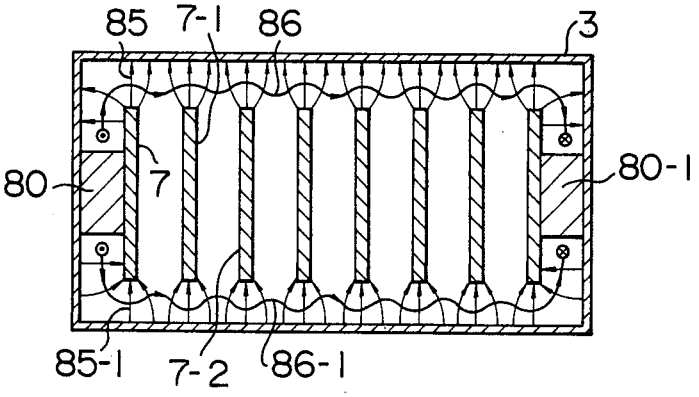
FIGS. 26, 27 and 28 are diagrams explaining the electromagnetic field in the above filter structure.

FIG. 26 shows the behavior of the electromagnetic field when the waveguide is excited in the TE10 mode. Upper and lower electric fields 85 and 85-1 have the same direction since they originate from a single TE10 mode wave. The same is true for magnetic fields 86 and 86-1. The metallic plates 7, 7-1, 7-2, and so on are spaced closely, and the electric fields 85 and 85-1 cannot enter in between, as has been mentioned previously. However, the electric fields can enter the spaces between the end metallic plates and the side walls of the waveguide 3, and the magnetic fields 86 and 86-1 also enter there. On this account, the surface currents flowing in the metallic plates in the axial direction concentrate in their edge sections, with only the end metallic plates allowing the surface currents to flow on their outer side. Consequently, the TE10 mode wave can be propagated in the axial direction without substantial loss of energy despite the presence of the absorbers.

Figure 27:
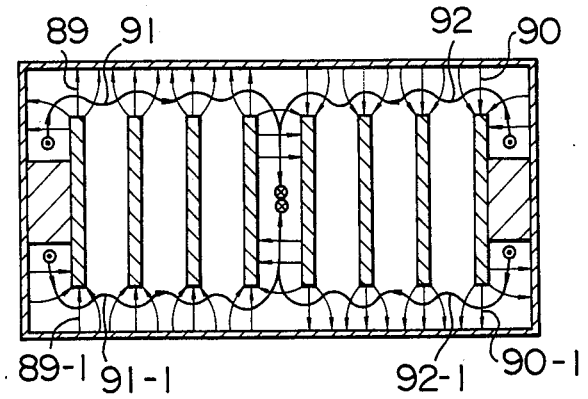

FIG. 27 shows the behavior of the electromagnetic field in the TE20 mode. In this mode, the electromagnetic field reverses at the middle of the waveguide, resulting in the creation of electric fields as shown by 89, 90, 89-1 and 90-1, and magnetic fields as shown by 91, 92, 91-1 and 92-1. The electric and magnetic fields enter the space between adjacent metallic plates at the middle of the waveguide. As in the case of the TE10 mode, the surface currents flow in the axial direction on the edges of the metallic plates, with the current direction reversing at the middle of the waveguide. Although the surface currents flow on the side of only the central metallic plate pair, as well as the end metallic plates, the TE20 mode wave is propagated in the axial direction without substantial energy loss. In case the absorbers exist, the electromagnetic field enters the central absorber, but its energy loss is a small proportion of the total energy transmission.

Figure 28:
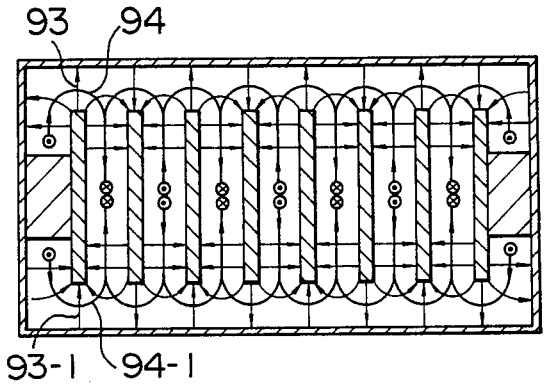

FIG. 28 shows the case of the TE80 mode, in which the electric fields 93 and 93-1 and magnetic fields 94 and 94-1 enter all spaces between metallic plates, and a significant energy loss is expected when the absorbers exist. Even if some part of the electromagnetic field escapes from absorption, the surface currents flowing on the edges of the metallic plates are invariably in the axial direction as in the cases of FIGS. 26 and 27.

Similar results are reached for remaining modes TE30, TE40, TE50, TE60, TE70 and the like, although they are not shown. Among these, the oddnumbered modes TE30, TE50 and TE70 will slightly differ from the results shown in the figures that are for the structure having the even number (8) of metallic plates, but there are no essential distinctions among all.

As described above, when the metallic plates do not have the cut configuration, the energy loss caused by the absorbers increases as the order (m) of TEmo modes goes higher, the TE10 mode wave is transmitted virtually without loss, and the surface currents flowing the metallic plate edges are parallel to the waveguide axis (along the edge).

A further material fact to be noted here is that the guide wavelength for TEmo modes are virtually constant independently of the value of m according to this embodiment. Conventional filters of this type have their guide wavelength greatly dependent on the mode and their dimensions need to be adjusted to each mode, whereas the filter structure of this embodiment provides a virtually constant guide wavelength regardless of the mode, eliminating the need of various dimensions.

Figure 29:
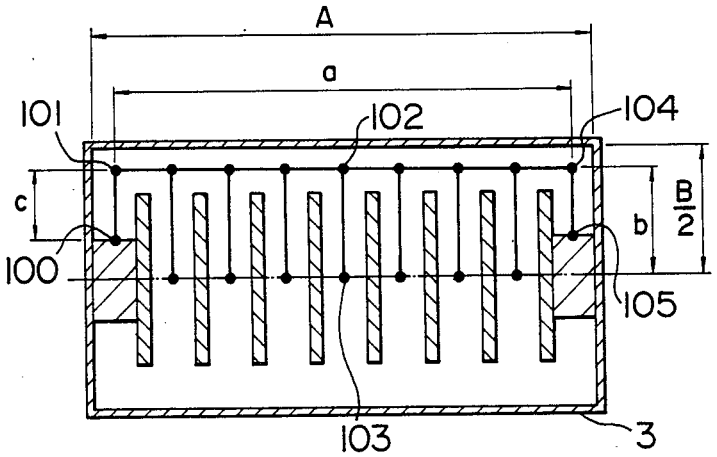
FIG. 29 is a diagram used to explain the determination of the cutoff wavelength.

The following describes using FIG. 29 the uniqueness of the guide wavelength in the whole TEmo modes. In the usual waveguide, the cutoff wavelength λcm of TEmo modes are expressed by the following equation.

$$\lambda cm = 2A/m \tag{20}$$

where A denotes the lateral dimension of the waveguide, and m denotes an integer.

On the other hand, the cutoff wavelength λc1 of the TE10 mode, as described on FIG. 26, is equal to the cutoff wavelength of a waveguide with a lateral dimension ranging from point 100 to 101 to 104 to 105 in FIG. 29. With dimensions a, b, c, A and B being defined as shown, the cutoff wavelength λc1 is expressed as follows.

$$\lambda c1 = 2(a+2c) \tag{21}$$

Similarly, the TE20 mode shown in FIG. 27 has its cutoff wavelength λc2 equal to that of a waveguide with the lateral dimension ranging from point 100 to 101 to 102 to 103 to 102 to 104 to 105 in FIG. 29. It is expressed as, $$\lambda c2 = a+2b+2c \tag{22}$$

The cutoff wavelength λc8 of the TE80 mode shown in FIG. 28 is equal to that of a waveguide demensioned to have a total length connecting all points in FIG. 29, and is expressed as follows.

$$\lambda c8 = \frac{a + 14b + 2c}{4} \tag{23}$$

Making a rough approximation c=b, the above equations are reduced to as, $\lambda c1 \approx 2a+4b$ $\lambda c2 \approx a+4b$ $\lambda c8 \approx a/4a+4b$ Accordingly, the cutoff wavelength is generally expressed as follows.

$$\lambda cm \approx 2a/m+4b \tag{24}$$

With further approximations $a \approx A$ and $b \approx B/2$, Equation (24) is reduced to as, $$\lambda cm \approx 2A/m+2B \tag{25}$$

Comparing Equation (20) with (25), the latter equation provides the output larger by 2B than the former equation. That is, Equation (25) implies that the cutoff wavelength becomes longer by 2B than the usual waveguide for arbitrary modes TEmo.

As has been described previously, the fundamental wave oriented standard waveguide WRJ-2 (EIA WR-430) provides the guide wavelengths λg10 and λg80 of the TE10 and TE80 modes at the fifth harmonic frequency 12.25 as follows.

$$\left.\begin{aligned} \lambda g10 &= 24.65 \text{ mm} \\ \lambda g80 &= 55.38 \text{ mm} \end{aligned}\right\} \tag{26}$$

In contrast, these guide wavelengths are calculated using the cutoff wavelength given by Equation (25) as follows.

$$\left.\begin{aligned} \lambda g10 &= 24.56 \text{ mm} \\ \lambda g80 &= 24.89 \text{ mm} \end{aligned}\right\} \tag{27}$$

The guide wavelengths of the two modes shown by (26) are apart by approximately a factor of 2, while the results shown by (27) are almost equal, implying very little difference in the guide wavelength among TEmo modes.

Figure 30:
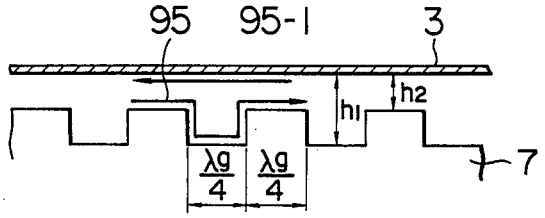
FIG. 30 is a diagram showing conceptually the shape of the filter element and the surface current.
Figure 31:
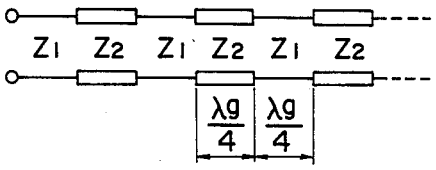
FIG. 31 is a diagram showing the equivalent circuit of the above filter structure.
Figure 32:
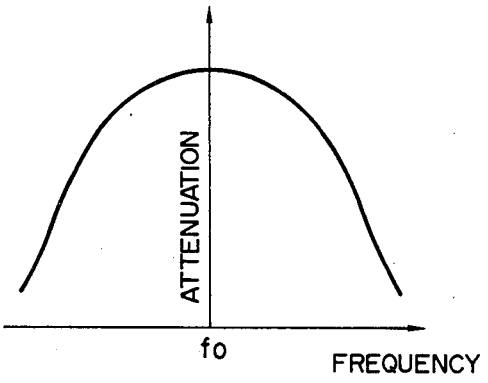
FIG. 32 is a graph showing the frequency response of the above filter structure.

Next, the cut configuration of the metallic plates 7, 7-1, 7-2, and so on will be described. In FIG. 30, cuts are formed at an interval of half the guide wavelength λg of the fifth harmonic in the edge of the metallic plate 7. The surface current 95 flows in parallel to the waveguide axis in the edge section as mentioned previously, which causes a counter surface current 95-1 to flow in the opposite direction on the interior wall of the waveguide 3. These sections can be expressed equivalently as two parallel lines shown in FIG. 31. In the equivalent circuit, pair lines with characteristic impedances Z1 and Z2 each having a length of λg/4 are connected in series alternately. This circuit is known to have a relatively broad attenuation characteristics centered by the frequency fo derived from λg as shown in FIG. 32. Since λg is virtually constant for the whole TEmo modes as described previously, the same attenuation effect is obtained for each mode of TEmo. The characteristic impedance is proportional to the distance as shown by h1 and h2 in FIG. 30, and the following relationship is met.

$$Z1/Z2=h1/h2 \quad (28)$$

Accordingly, the larger the ratio of h1 to h2, the greater attenuation effect is accomplished.

Thus, a satisfactory blocking (attenuating) effect against the fifth harmonic can be attained by a simple filter structure which includes the metallic plates 7, 7-1, 7-2, and so on manufactured through the inexpensive plate work.

Finally, the reason why the fundamental wave is transmitted without loss will be described. The fundamental wave is transmitted in the TE10 mode, as is known in the art. On the other hand, the fifth harmonic in the TE10 modes can also be transmitted without substantial loss provided that the metallic plates have no cut formation on their edges, as described on FIG. 27. The fundamental wave has its guide wavelength longer by five times than that of the fifth hamonic, and is large enough as compared with the dimensions of the cuts when provided. On this account the fundamental wave is less affected by the presence of the cuts, and can be transmitted virtually without loss.

According to this invention, as described above, the fifth harmonic in numerous modes created as spurious emission by the magnetron can effectively be prevented from leaking into the heating chamber, and an inexpensive waveguide filter for use in a microwave oven is realized.

The present invention is not restricted to the elimination of the fifth harmonic and is applicable to the elimination of other harmonics by suitably selecting the number of the metallic plates and the dimension of the corrugated sections.

We claim:

1. A waveguide filter for use in a microwave oven comprising:

a plurality of elongated flat metallic plates disposed in a waveguide, said waveguide having a substantially rectangular cross-section with a pair of side walls and upper and lower walls, said plurality of elongated metallic plates having the flat surfaces thereof extending substantially in parallel to the side walls of said waveguide, each one of said metallic plates having a series of openings at a constant interval therebetween extending in the longitudinal direction of said metallic plates at upper and lower edges thereof so as to provide a corrugated configuration;

first means for providing a predetermined spacing between adjacent ones of said metallic plates and for holding said metallic plates substantially in parallel to one another; and second means including metal members disposed between the side walls of said waveguide and the ones of said metallic plates adjacent the side walls of said waveguide for providing a substantially uniform clearance between the upper and lower edges of said metallic plates and the respective upper and lower walls of said waveguide and for holding said metallic plates substantially in parallel to the side walls of said waveguide.

2. A waveguide filter according to claim 1, wherein each one of said series of openings in the upper and lower edges of said metallic plates have a depth and the constant interval therebetween substantially equal to one quarter of a predetermined harmonic wavelength.

3. A waveguide filter according to claim 1, wherein each one of said series of openings in the upper and lower edges of said metallic plates have a width in the longitudinal direction of said metallic plates substantially equal to one quarter of a predetermined harmonic wavelength and the constant interval therebetween substantially equal to one half of the predetermined harmonic wavelength.

4. A waveguide filter according to claim 1, wherein said first means includes upper and lower edges forming the upper and lower walls of said waveguide, respectively, and a clearance between the upper and lower edges of said first means and the upper and lower walls of said waveguide is substantially less than one half of a predetermined harmonic wavelength.

5. A waveguide filter according to claim 1, wherein said first means include microwave absorbers and said second means include metal members.

6. A waveguide filter according to claim 5, wherein said microwave absorbers comprise one of ferrite and carbon.

* * * * *